United States Patent [19]

Lee

[11] 4,306,834

[45] Dec. 22, 1981

[54] BALANCE PISTON AND SEAL FOR GAS TURBINE ENGINE

[75] Inventor: Richard M. Lee, Media, Pa.

[73] Assignee: Westinghouse Electric Corp., Pittsburgh, Pa.

[21] Appl. No.: 51,912

[22] Filed: Jun. 25, 1979

[51] Int. Cl.[3] ..... F03B 11/00; F04D 29/08

[52] U.S. Cl. ..... 415/116; 417/173

[58] Field of Search ..... 416/95; 415/104, 105, 415/116, 115

[56] References Cited

U.S. PATENT DOCUMENTS

| | | | |
|---|---|---|---|
| 2,410,769 | 11/1946 | Baumann | 415/104 |
| 2,647,684 | 4/1953 | Lombard | 417/365 |
| 2,966,296 | 12/1960 | Morley et al. | 415/105 |
| 3,602,605 | 8/1971 | Lee | 415/116 |
| 3,814,539 | 6/1974 | Klompay | 416/95 |
| 3,846,899 | 11/1974 | Gross | 415/174 |
| 3,936,216 | 2/1976 | Dixon | 415/116 |

FOREIGN PATENT DOCUMENTS

| | | | |
|---|---|---|---|
| 1194663 | 6/1970 | United Kingdom | 415/115 |
| 1476237 | 6/1977 | United Kingdom | 416/174 |

*Primary Examiner*—William L. Freeh

*Attorney, Agent, or Firm*—E. F. Possessky

[57] ABSTRACT

The turbine section of a gas turbine engine includes structure in the disc cavity for separating high pressure air into cooling air for delivery to cooled blades and sealing air for preventing hot motive fluid from entering the cavity. A disc cavity seal is provided to minimize leakage of the sealing air into the motive gas path resulting in increased air pressure on the air separator structure (which is integrally attached to the rotor) and providing a balance piston for counteracting the normal thrust on the rotor and reducing the thrust bearing load. The resultant decrease in leakage of high pressure air also improves the engine performance efficiency.

6 Claims, 3 Drawing Figures

BALANCE PISTON AND SEAL FOR GAS TURBINE ENGINE

BACKGROUND OF THE INVENTION

1. Field of the Invention

This invention relates to a gas turbine engine and more particularly to air separator and sealing structure in the turbine portion thereof providing a thrust balance piston to counteract the thrust of the turbine rotor.

2. Description of the Prior Art

The present trend in high efficiency combustion turbine engine design is to increase their firing temperature and effective pressure ratio. As a result, the engine net thrust also increases. The conventional manner of accommodating increased thrust is to either use a larger thrust bearing capable of withstanding the larger thrust but which is more expensive and also increases the heat loss, or to create a "balance piston" comprising high pressure air acting on the rotor in opposition to the rotor thrust, thus reducing bearing load.

In such a balance piston, high pressure air is introduced to the pressure face of the structure acting as the piston. The air pressure acts on the effective area of the pressure face to counteract the engine thrust. Use of this high pressure air for other than generating power in the turbine reduces the overall engine efficiency and thus both methods generally increase the expense of the engine and reduce its performance.

Presently, the assignee of the present invention manufactures a gas turbine engine having certain structure in the compressor section thereof which is subjected to high pressure air from the compressor to provide a thrust balance piston in opposition to the net rotor thrust. However, introduction of high pressure air into this relatively low pressure area of the compressor, to obtain a sufficient differential in pressure on the opposite faces of the balance piston structure to generate the thrust, is generally inefficient in that it also permits a relatively large amount of leakage of the high pressure air. This lost air is returned to the compressor for recompression without providing any useful work, and, in at least the particular gas turbine engine above referred to, the effective area of the pressure face is relatively small.

U.S. Pat. No. 2,966,296 shows a gas turbine engine with a thrust balancing structure in the turbine section. The description therein is sufficient to generally describe a gas turbine and the function and operation of the thrust balancing feature and to describe in detail the particular structure appropriate for the particular gas turbine shown. The thrust balancing air in this patent is routed to individual downstream turbine stages, requiring many labyrinth seals and in fact, is routed to certain downstream chambers wherein the air pressure opposes the thrust balancing force on the opposite face of each rotor disc stage. Further, in that it is necessary to obtain flow throughout the path of this pressurized air to the downstream chambers, the various seals must be maintained within relatively close tolerances to permit such flow and yet provide the desired pressure drop to produce the balancing thrust.

SUMMARY OF THE PRESENT INVENTION

The present invention provides a singular seal, the only criterion of which is to provide minimal seal clearance, in the turbine section of a gas turbine engine to confine sealing air in the turbine disc cavity, thereby causing a pressure on the upstream face of the first stage rotor disc in opposition to the rotor thrust on the bearings. In the particular gas turbine shown, this balancing thrust is obtained with no additional air requirements than heretofore supplied for the sealing air and, in fact, reduces the air flow through the seals in the disc cavity to improve overall turbine performance.

DRAWING DESCRIPTION

DESCRIPTION OF THE PREFERRED EMBODIMENT

Figure 1:
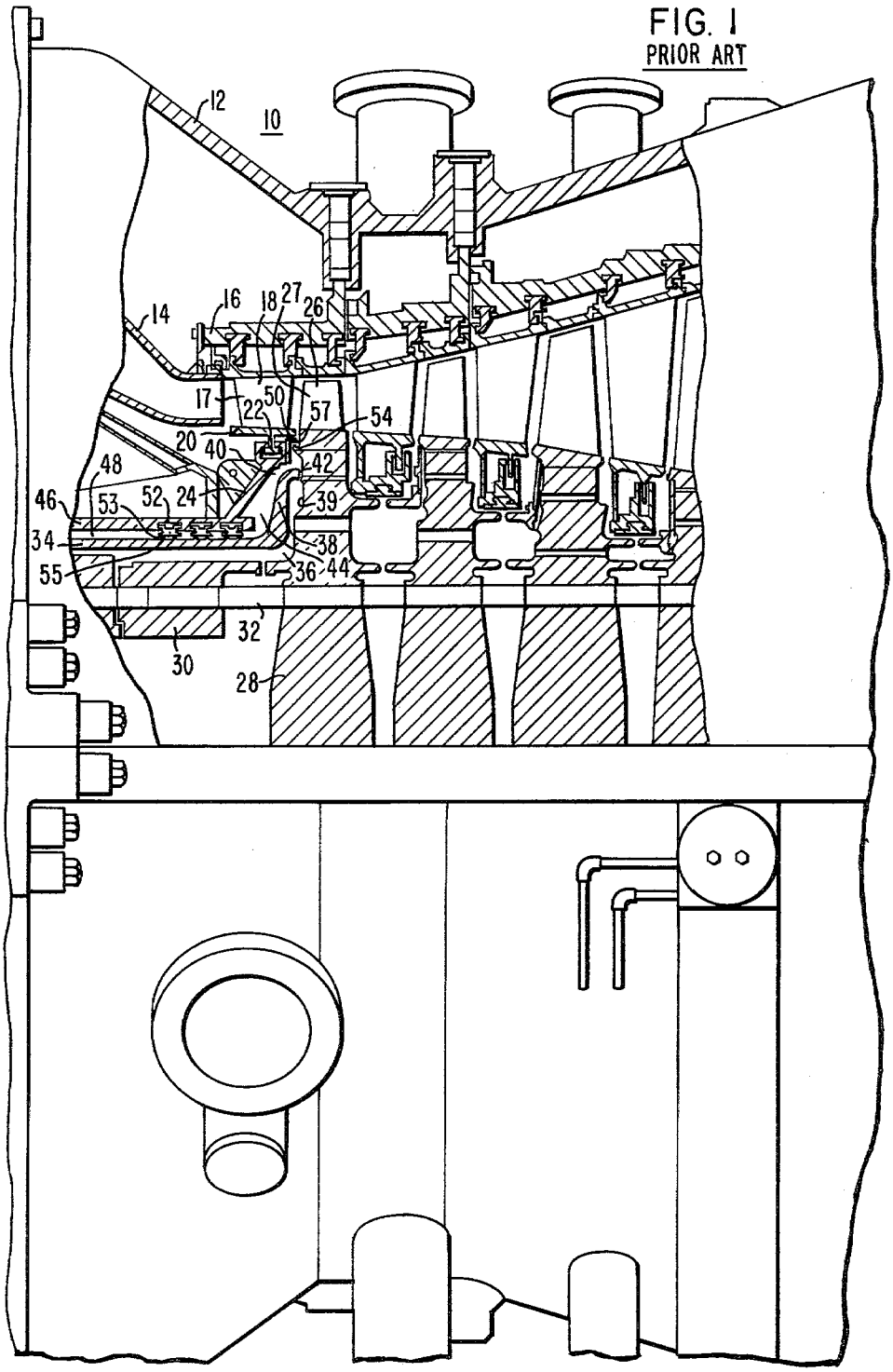
FIG. 1 PRIOR ART
FIG. 1 is a cross-sectional view in the vicinity of the nozzle vanes and first stage rotor disc of a gas turbine engine showing structure of a commercially available gas turbine engine.

FIG. 1 shows a cutaway portion of a gas turbine engine generally adjacent the nozzle vanes and cooled first row blades in the turbine portion and is a structure which is typical of a commercially available gas turbine engine of the assignee of the instant invention.

As therein seen, the turbine 10 includes an outer casing 12 enclosing, in this portion, the discharge end of the combustion chamber 14, and an outer vane ring support 16 for mounting the first row vanes 18 with an air foil portion 17 in the gas path from the combustion chamber. The vanes 18 also include an inner shroud portion 20 having an inner circumferential rib 22 on which is supported a static seal holder 24.

The first row blades 26 are supported on a rotor disc 28 and also have an airfoil portion 27 in the gas path. The disc is integrally attached to a rotor 30 as though torque bars 32 passing therethrough to drive the rotor as it rotates.

An air separator 34 encloses the rotor 30 in radial spaced relation therewith to define an air flow path 36 to deliver cooling air to the root of the blades 26. The air separator 34 terminates adjacent the face of the rotor disc 28 in a radially outwardly extending flange 38 which is also in spaced relationship with the disc face 39 to define the downstream end of the cooling air path 36. The terminal end 40 of the air separator is in generally sealing and abutting engagement with the blade root 26 and disc face 39 assembly subadjacent the blade platform as at 42 to minimize leakage of the cooling air from between the blade and the air separator 34.

The air separator 34 is integrally connected to, and rotates with, the rotor 30 and disc 28. Thus, to prevent the hot motive gas in the gas flow path from flowing into the disc cavity 44, seals are provided between the stationary structure depending from the vane row 18 and the rotating disc and rotor structure. In this regard, the static seal holder 24 extends inwardly from the inner rib 22 of the inner shroud 20 and is integral with a seal holding tube 46 which encloses in spaced relation the air separator 34 to define a sealing air flow path 48. A plurality of labyrinth seal rings 52, defining seal points 53 projecting towards the air separator 34 are supported in the tube 46 in cooperating sealing engagement with the sealing lands 55 on the surface of the air separator 34. Also a circumferential sealing flange 50 extends axially downstream from the static seal holder 24 subadjacent the vane inner shroud 20 and radially outwardly from an upstream extending circumferential lip 54 on the first row blade and disc assembly. A honeycomb sealing ring 57 on flange 50 is disposed in general sealing relationship with the lip 54 as an air seal from the cavity 44.

High pressure air from the compressor section is directed to both the air flow path 36 and the space 48 between the tube seals and the air separator to provide positive air flow in the downstream direction through these two air paths. The air flowing through the cooling air flow path 36 is delivered to the blade root for cooling air flow through the blade in any well known manner whereas the air flow through the path 48 is maintained separate from the cooling air in path 36 and, in leaking through the labyrinth seals 52, maintains the seals relatively cool. Upon exiting the labyrinth seals, the air flows into the disc cavity 44 and exits this cavity through the seal 54 into the motive gas flow path, thereby preventing the hot motive gas from entering the disc cavity 44.

Figure 2:
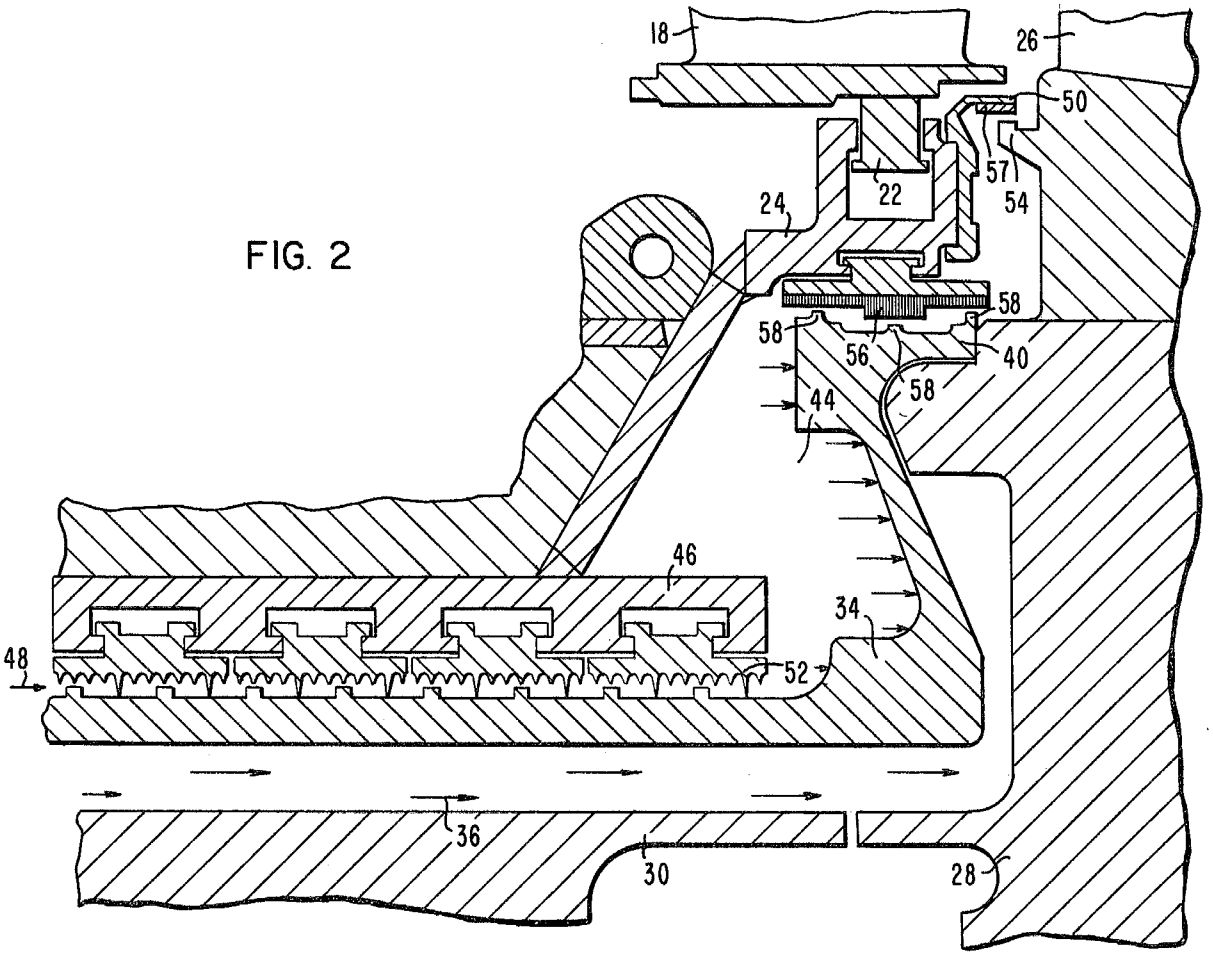
FIG. 2 is a view similar to FIG. 1 showing the structure of a gas turbine engine with the present invention.

Referring now to FIG. 2, the structure of the present invention is seen to comprise essentially the gas turbine structure herebefore identified, i.e., a first vane row 18 with an inwardly extending rib 22, a static seal holder 24 attached to the rib and extending inwardly to a seal mounting tube 46, an air separator 34 and a rotor 30, disc 28, and blade 26 assembly that in their assembled relationship define a cooling air flow path 36 and a sealing air flow path 48 into the disc cavity 44 through the seal points 52 of the labyrinth seal. Also, the sealing ring 57 is maintained adjacent the hot gas between the sealing flange 50 on the static seal holder 24 and the circumferential flange 54 on the blade assembly. However, additionally, the seal holder 24 supports a honeycomb circumferential seal ring 56 in axial alignment with the radially innermost terminal end 40 of the air separator 34. The end 40 of the air separator 34 is configured to define a plurality of axially separated seal points 58 to define, in conjunction with the facing honeycomb seal ring 56, a labyrinth seal structure. It will be noted that the axial dimension of the honeycomb seal 56 and the facing portion 40 of the air separator 34 defining the seal points 58 is such as to provide a tortuous flow path effective to substantially seal the disc cavity 44. This seal provides generally high pressure air retained in this disc cavity 44 exerting an axial force on the face of the air separator 34 as depicted by the arrows, in opposition to the thrust on the rotor. Since the air separator 34 abuts and is generally integral with the rotor disc and blade assembly, the effect of the air pressure thereon is to counterbalance the rotor thrust. The force of the counterbalance is determined by the disc cavity air pressure and the effective area of the pressure face which, in this section of the turbine is relatively large.

In addition to providing a thrust balancing piston, i.e., the face of the air separator 34, the added air seal provided by the seal ring 56 and seal points 58 reduces the volume of air flow through the disc cavity 44 and thereby increases the overall engine efficiency or, in the alternative, permits more air to be utilized for cooling the blade which in turn permits higher turbine temperatures and again leads to greater turbine efficiency.

It will be noted that the seal points 58 of the present invention are on the axial face of the air separator 34 which is a rotating part. In case of a rub between the seal points 58 and the facing honeycomb, seal ring 56, the heat generated by the points will be on the stationary honeycomb so that any damage done to structure by such heat will be on the stationary structure which is relatively easily replaced. Further, this seal is permitted to make its own clearance as the seal points 58 and the honeycomb ring 56 are assembled in contact and are gradually worn into each other. This permits a minimum clearance for the seal points 58 and more effectively seals the cavity 44.

Figure 3:
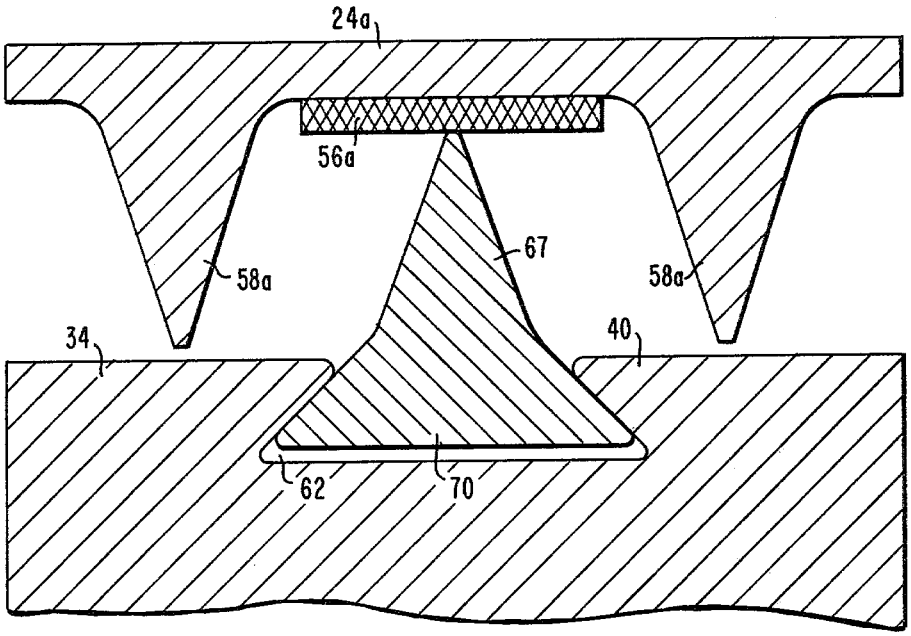
FIG. 3 is an alternative seal to the air seal of FIG. 2.

Referring now to FIG. 3, an alternative seal configuration is shown for sealing the facing surfaces of the air separator 34 and the honeycomb seal ring and support structure **56*a* in the static seal holder. In this configuration, an intermediate seal point 67 is mounted on the axial upper face 40 of the air separator 34 between a pair of seal points 58*a* depending from the static seal holder 24*a*. A honeycomb seal ring 56*a* is attached to the seal holder 24*a* between the seal points 58*a* and in axial alignment with the rotating seal point 67**.

The rotating seal point 67 is retained within a dovetailed circumferential groove 62 and has complementary angled sides to provide sufficient seal-root 70 to groove 62 contact to withstand the centrifugal force as the seal 67 and separator rotate. Thus, as the turbine rotor reaches its normal running speed, the centrifugal force forces the seal point 67 outwardly to machine a groove into the facing honeycomb seal ring **56*a* to provide a theoretical zero clearance. The wedge-like contact at the seal root 70 and groove 62 interface permits radial movement of the seal point 67 to maintain permanent tip contact with the honeycomb ring 56*a* and the tapered shape of the seal minimizes the centrifugal force loading on the seal root 70. This seal structure again provides a labyrinth seal arrangement of sufficient sealing capabilities to maintain a pressure within the disc cavity 44 for maintaining air pressure on the face of air separator 34** to define the counterbalancing thrust piston previously described.

I claim:

1. In a gas turbine engine defining an annular motive gas path, an annular row of stationary vanes having an air foil portion in the motive gas path and a rotatable disc supporting an annular row of rotating blades adjacent said vanes and also having an air foil portion in the motive gas path, a rotor member attached to and driven by said disc, rotating means attached to said rotor member and enclosing an axial portion of said rotor member in spaced relation and terminating in a radially extending face abutting said disc adjacent the blades mounted thereon to define an air flow path for delivering cooling air to said blades, and stationary means attached to said row of vanes and generally enclosing an axial portion of said rotating means in spaced relation to define a sealing air flow path into a disc cavity therebetween with relatively high pressure air flowing therethrough to prevent said hot motive gas from entering said cavity;

a first sealing means positioned generally radially inwardly the air foil portions of said vanes and blades, respectively, to obstruct hot motive gas entering the cavity; and a second sealing means positioned downstream of the disc cavity but upstream and radially inwardly of said first sealing means to generally closely seal the sealing air within said cavity and thereby pressurize said cavity with said high pressure air providing a force on said radially extending face of said rotating means in opposition to the normal net thrust on said rotor.

2. A gas turbine engine according to claim 1 wherein said second sealing means comprises structure defining a labyrinth seal.

3. A gas turbine engine according to claim 2 wherein said labyrinth structure includes an axial portion of the radially outermost part of the radially extending face of said rotating structure and an opposing axially extending annular sealing ring mounted on said stationary means.

4. A gas turbine engine according to claim 3 wherein said axial portion of said face of said rotating structure includes a plurality of circumferential radially outwardly projecting seal points and said annular sealing ring comprises a stationary circumferential honeycomb seal which is contoured to provide a surface in sealing relationship with every seal point to provide a tortuous flow path through said sealing means.

5. A gas turbine engine according to claim 2 wherein said second sealing means comprises:

an annular honeycomb seal ring on the stationary means attached to the vanes;

a circumferential seal point mounted within an annular groove on the rotating means with the radially outermost end of said seal point in sealing relationship with said seal ring and wherein said seal point defines an annular ring having outwardly diverging sidewalls; and said annular groove in the rotating means includes sidewalls complementary to said seal point to retain said ring in said groove under centrifugal force.

6. A gas turbine engine according to claim 5 wherein said stationary means includes a pair of seal points projecting inward toward said rotating means, with each such seal point disposed on axially opposed sides of said rotating seal point and in general sealing relationship with said rotating part to define a labyrinth type seal.

* * * * *